United States Patent [19]

Radtke

[11] 4,274,616

[45] Jun. 23, 1981

[54] BOOK STAND

[76] Inventor: Alfred G. Radtke, 2351 N. Fernview, Simi Valley, Calif. 93065

[21] Appl. No.: 32,101

[22] Filed: Apr. 20, 1979

[51] Int. Cl.[3] ..... A47B 97/04

[52] U.S. Cl. ..... 248/459

[58] Field of Search ..... 248/450, 459, 460

[56] References Cited

U.S. PATENT DOCUMENTS

| | | | |
|---|---|---|---|
| 844,066 | 2/1907 | Warren | 248/459 |
| 1,207,577 | 12/1916 | Loose | 248/459 |
| 2,262,240 | 11/1941 | Koeble | 248/459 X |
| 3,555,895 | 12/1970 | Guiles | 248/460 X |

*Primary Examiner*—William H. Schultz

*Attorney, Agent, or Firm*—Roger A. Marrs

[57] ABSTRACT

A stand or supporting books, magazines, pamphlets or other reading material is disclosed herein having a blank provided with score lines defining fold or bending lines which when so folded or bent provides a rearwardly angled back member having triangular side pieces serving as braces with lateral base strips forming a stabilized bottom. The front or lower edge or back member includes a forwardly angled lip on which the book or other reading material rests and further includes a downwardly angled front support member engaging the support surface for stabilizing the lip. A rear brace member is selectively engaged between the base strips for rigidizing the construction.

5 Claims, 6 Drawing Figures

FIG. 1
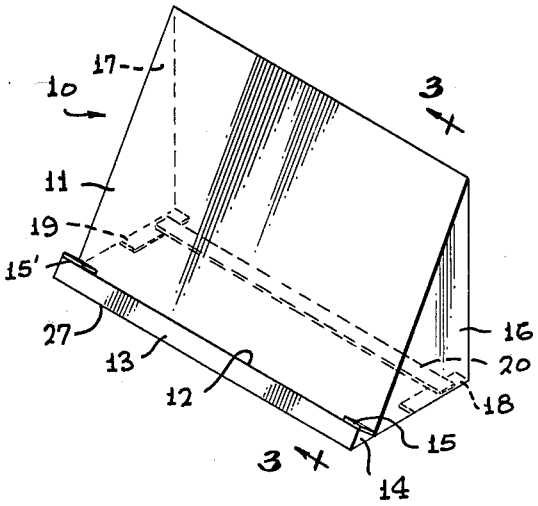
FIG. 2
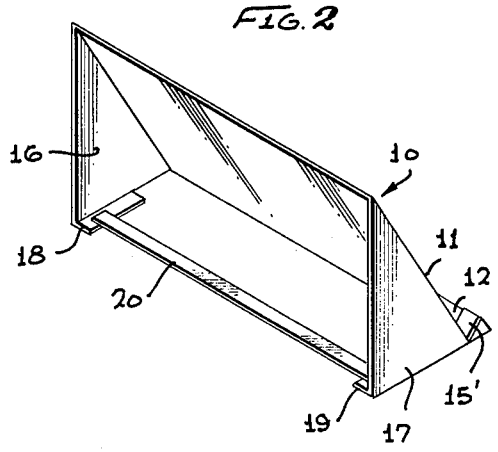
FIG. 3
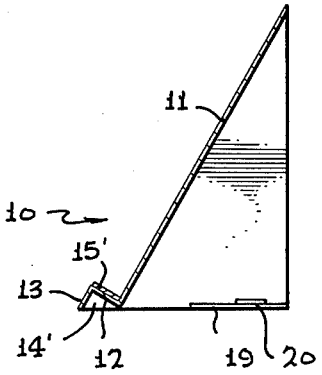
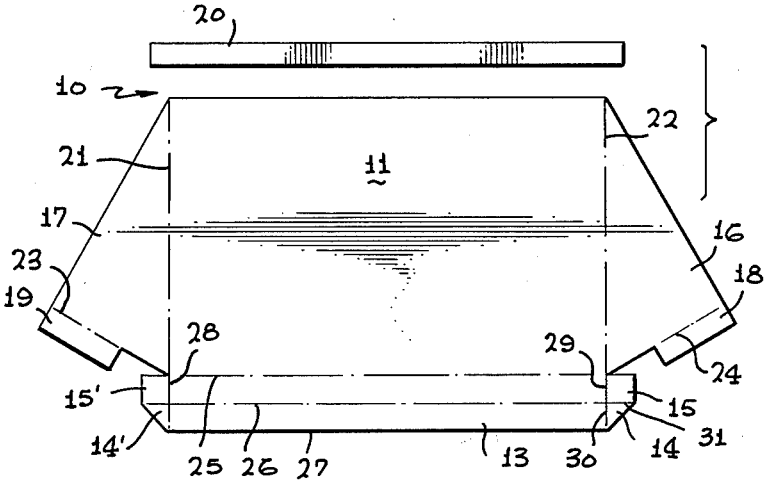
FIG. 4
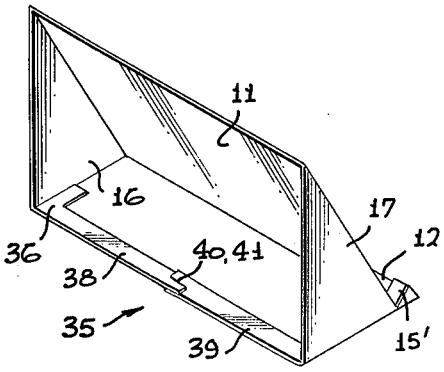
FIG. 5
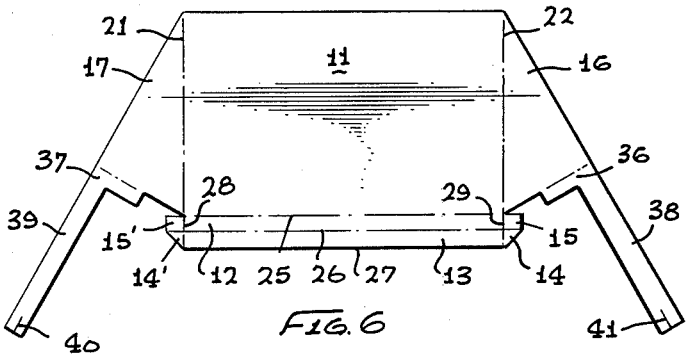
FIG. 6

BOOK STAND

BACKGROUND OF THE INVENTION

1. Field of the Invention

The present invention relates to book stands or the like and more particularly to a novel stand which is portable and that may be readily constructed from a blank of sheet material and which may be readily assembled and disassembled at the selection of the user.

2. Brief Description of the Prior Art

In the past, it has been the conventional practice to employ a variety of angled support members for holding books and other reading material at an angle to the readers view. Such devices permit the readers hands to be free for the taking of notes or for performing other projects such as knitting or the like. Also, the use of book stands is less tiring to the reader.

Generally, prior book stands have been made of rigid material which is heavy, cumbersome, and occupies a substantial volume of space so that storage is difficult. Also, the weight of the stand is generally heavy and does not lend itself to portability because of the weight and because of the large volume occupied by the construction.

Furthermore, because of the aforementioned difficulties and problems, the conventional book stands for reading material are relatively expensive to manufacture and are not convenient for use by the average reader. Therefore, a long standing need has existed to provide a new book stand which is portable in construction, economical in structure and which is conveniently usable by readers.

SUMMARY OF THE INVENTION

Accordingly, the above problems and difficulties are obviated by the present invention which provides a novel book stand comprising a blank of sheet material having a plurality of scored lines which when bent or folded upon provides a support for reading material constituting a angular back member having a forward lip at its lower end and a pair of side braces or supports on the opposite sides of the back member. Means are provided on the braces or supports for stabilizing the construction on a supporting base and brace means are provided for rigidizing the construction once folding or bending has taken place.

Therefore, it is among the primary objects of the present invention to provide a novel stand for reading material which may be readily formed from a blank of sheet material by folding and bending upon pre-determined scored lines provided on the surface of the blank.

Another object of the present invention is to provide a novel book stand which may be readily assembled and dis-assembled by the user so that the construction is completely portable in concept and construction.

Still another object of the present invention is to provide a novel stand for reading material which is relatively inexpensive to manufacture and which is convenient to use by a reader because of its portable construction.

A further object of the present invention is to provide a novel book stand which is portable and comprises a rearwardly sloping or angled back member having a reinforced lip at its lower end and lateral brace means on opposite sides thereof as well as a base support means to rigidize the construction.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel stand for reading material incorporating the present invention;

FIG. 2 is a rear perspective view of the novel book stand for reading material shown in FIG. 1;

FIG. 3 is a transverse cross-sectional view of the novel book stand shown in FIG. 1 as taken in the direction of arrow 3—3 thereof;

FIG. 4 is an exploded view showing the blank of sheet material preparatory to being bent or folded into the configuration shown in FIGS. 1 and 2;

FIG. 5 is a rear perspective view of another version of the present invention;

FIG. 6 is a layout view or diagram of the blank of sheet material from which the embodiment shown in FIG. 5 is constructed.

DESCRIPTION OF PREFERRED EMBODIMENT

Referring to FIG. 1, the novel stand for reading material incorporating the present invention is illustrated in the general direction of arrow 10. The stand includes a back member 11 for supporting the back of the reading material, such as a book for example, and the back member 11 extends or slopes rearwardly from the front of the device. The lower end of the back member 11 forms a lip 12 which slopes forwardly from the back member at an angle thereto so as to support the bottom of the reading material. The lip 12 is supported by a forward element 13 which includes triangular side pieces 14 on each side of the lip or tray like construction. Reinforcing tabs 15 are also provided adjacent each of the triangular section 14.

The back member 11 further includes lateral side pieces or elements 16 and 17 which also provides bottom strips 18 and 19 respectively. The strips 18 and 19 are joined by a brace 20 which serves to rigidize the entire construction once it is installed.

As shown in detail in FIG. 2, the brace 20 is secured at its opposite ends to the exposed surface of the strips 18 and 19 respectively. The triangular section and tabs associated with the opposite end of the device from the end illustrating section 14 and tab 15 are indicated by the reference characters 14' and 15' respectively.

Referring now in detail to FIG. 3 it can be seen that the tab 15' is secured, by any suitable means such as adhesive or the like, to the upper surface of the lip 12. Also, it can be seen that the combined structure of the angled lip 12 and the sloping back member 11 serves as a tray like support for the reading material carried therein. The reading material is at a preferred and predetermined angle with respect to the viewers eye so that the reading procedure is augmented.

Referring now in detail to FIG. 4, it is a primary feature of the present invention that the book stand for reading material be portable and be readily constructed from a blank of sheet material. The stand 10 is illustrated as a sheet of thin material such as cardboard of the like and includes a pair of score lines 21 and 22 which when bent or folded will provide the lateral side members or elements 16 and 17 respectively. Score lines 23 and 24 will provide the base strips 18 and 19 while the score lines 25 and 26 will provide the lip 12. The score lines 25 and 26 are parallel to each other and are formal or at right angles to the score line 21 and 22. The front element 13 is defined by the score line 26 and provides a edge 27 which rests on a supporting surface. The tabs 15 and 15' are separated from the opposite ends of the lip 12 by slots 28 and 29 while the triangular members 14 and 14' are defined between score lines 30 and 31. The brace member 20 is a separate piece and is attached to the base strips 18 and 19 after the blank has been folded about the aforementioned score lines.

Therefore, it can be seen that the novel stand of the present invention provides an inexpensive and easy-to-install construction for supporting a book or other reading material at a proper angle and distance from the reader. The blank is of unitary construction and by pre-determined location of the various score lines, folding and bending can take place so as to provide the structure as described. Attachments of the opposite ends of brace 20 as well as of the tabs 15 and 15' to the opposite ends of the lip 12 may be readily achieved by any suitable means such as by adhesive.

Referring now to FIG. 5, another embodiment of the present invention is illustrated in the general direction of arrow 35. The embodiment illustrated is substantially similar to the embodiment shown in FIGS. 1 and 2 and for like parts therein, identical reference characters are employed in the embodiment of FIG. 5. The modification of FIG. 5 is in the base strip 18 and 19 which in FIG. 5 is identified by numeral 36 and 37. The base strips 36 and 37 are provided with elongated portions 38 and 39 which terminate in slots 40 and 41 respectively. During the folding procedure, slot 41 is inserted into the slot 40 carried on the opposing ends of the extensions 38 and 39 of the base strips. The slots engage in the manner shown in FIG. 5 so that a rigid brace extends between the lateral side elements are members 16 and 17.

Following the concept of the present invention, the embodiment shown in FIG. 5 can be formed from a single blank of sheet material as shown in FIG. 6. The blank includes score lines as previously described with respect to the embodiment shown in FIG. 4 and identical reference numbers are employed for identical score lines. However, instead of the separate piece 20 as shown in the embodiment in FIG. 4, the version shown in FIG. 6 includes the rigid brace as part of the blank identified by extensions 38 and 39 of base strips 36 and 37. Therefore, the version shown in FIGS. 5 and 6 is intergral and provides a unitary structure which is of a single piece construction not requiring external pieces or parts. The version shown in FIG. 5 may be utilized in the same manner as previously described with respect to the embodiment shown in FIGS. 1-4 inclusive.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A reading stand comprising the combination of:

a blank of sheet material divided into a plurality of integral parts;

score lines intended to be folded over so that said integral parts provide an upright structure supportable on a flat surface;

said upright structure including said integral parts having a back member angularly related to said flat surface and a forward extending lip arranged normal to said back member whereby said back member and said lip cooperate in an engagingly manner to receive and hold a book;

side elements at each side of said back member bracing said back member on said flat surface;

base support means carried on said side elements and said lip for rigidizing and stabilizing said upright structure; and said base support means including a flap strip foldably carried on the lower edge of each of said side elements being folded towards each other and a brace strip detachably interconnecting said flap strips together.

2. The invention as defined in claim 1 wherein:

said base support means further includes triangular pieces folded over at each end of a forward element foldably carried on said lip opposite to its side attached to said back member.

3. The invention as defined in claim 2 wherein:

each of said triangular pieces includes a tab adapted to be inserted beneath the opposite ends of said lip and adapted to be secured thereto.

4. The invention as defined in claim 3 wherein:

said brace strip is in two parts, each part having one end thereof attached each of said base strips respectively and their opposite ends having mating slots for effecting a detachable connection therebetween.

5. The invention as defined in claim 4 wherein:

said forward element extends forward of said lip at a ninety degree angle thereto.

* * * * *